US010920358B2

(12) United States Patent
Ak et al.

(10) Patent No.: US 10,920,358 B2
(45) Date of Patent: Feb. 16, 2021

(54) BALANCING APPARATUS OF A WASHING MACHINE

(71) Applicant: Vestel Elektronik Sanayi ve Ticaret A.S., Manisa (TR)

(72) Inventors: Yusuf Ak, Manisa (TR); Nevzat Yalin, Manisa (TR)

(73) Assignee: Vestel Elektronik Sanayi ve Ticaret A.S.

( * ) Notice: Subject to any disclaimer, the term of this patent is extended or adjusted under 35 U.S.C. 154(b) by 57 days.

(21) Appl. No.: 16/298,388

(22) Filed: Mar. 11, 2019

(65) Prior Publication Data

US 2019/0276969 A1 Sep. 12, 2019

(30) Foreign Application Priority Data

Mar. 9, 2018 (EP) ..... 18160973

(51) Int. Cl.

| | |
|---|---|
| ***D06F 33/00*** | (2020.01) |
| ***D06F 37/02*** | (2006.01) |
| ***D06F 37/20*** | (2006.01) |
| ***D06F 37/22*** | (2006.01) |
| ***D06F 37/26*** | (2006.01) |

(52) U.S. Cl.

CPC ..... *D06F 37/225* (2013.01); *D06F 33/00* (2013.01); *D06F 37/203* (2013.01); *D06F 37/265* (2013.01); *D06F 37/02* (2013.01); *D06F 2222/00* (2013.01)

(58) Field of Classification Search

CPC ..... D06F 33/00; D06F 37/02; D06F 37/203; D06F 37/225; D06F 37/265; D06F 2222/00

USPC ..... 68/12.06, 12.27, 23.2, 23.3, 23.7

See application file for complete search history.

(56) References Cited

U.S. PATENT DOCUMENTS

| | | | |
|---|---|---|---|
| 5,561,990 | A | 10/1996 | Berkcan et al. |
| 2016/0258102 | A1 | 9/2016 | Kim et al. |

FOREIGN PATENT DOCUMENTS

| | | | |
|---|---|---|---|
| DE | 10 2016 220112 | A1 | 5/2017 |
| WO | 2012/089453 | A1 | 7/2012 |
| WO | 2017/009170 | A1 | 1/2017 |

OTHER PUBLICATIONS

Extended European Search Report issued in connection with European Patent Application No. 18160973.6 dated Sep. 14, 2018, 7 pages.

*Primary Examiner* — Levon J Shahinian

(74) *Attorney, Agent, or Firm* — McDonnell Boehnen Hulbert & Berghoff LLP

(57) ABSTRACT

The present invention refers to a balancing apparatus 100 for preventing vibrations and loud running in a drum 1 of a washing machine while operating. The balancing apparatus 100 according to the present invention preferably comprises of at least two half rings 2 and a plurality of propellers 3. The plurality of propellers are attached to the drum 1. The two half rings 2 are configured to cover the drum 1. The propellers 3 and the half rings 2 are magnetically polarized while electric current is passing through the propellers 3 and half rings 2. The drum 1 is balanced by forming similar polarity in poles of the half rings 2 and the poles of the propellers 3 facing each other.

6 Claims, 1 Drawing Sheet

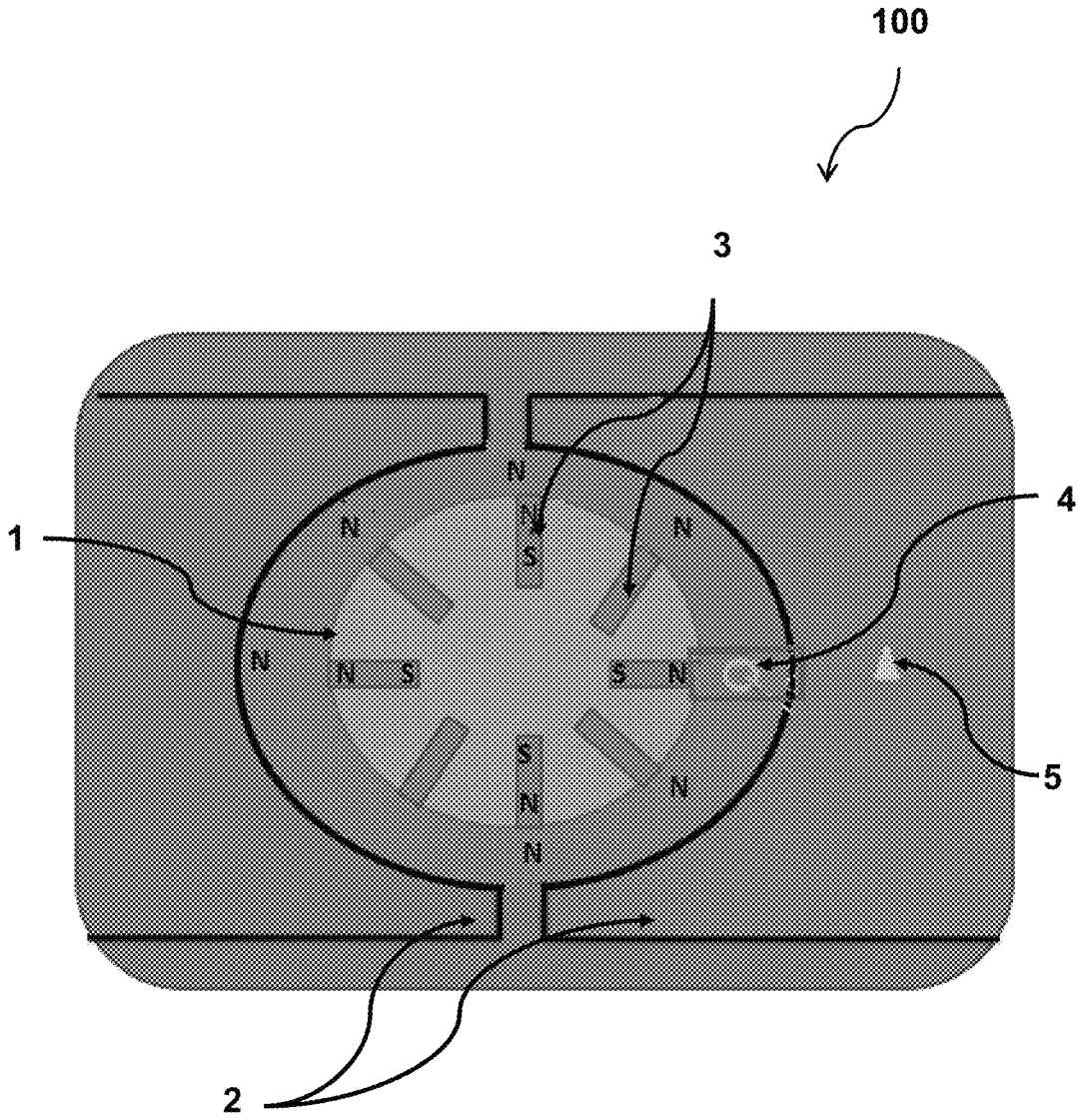
100
3
1
4
5
2
N
N
N
N
S
N
S
S
N
S
N
N
N

BALANCING APPARATUS OF A WASHING MACHINE

This application claims priority from European Patent Application No. 18160973.6, filed Mar. 9, 2018, which is hereby incorporated by reference it its entirety.

This invention refers to a balancing apparatus for preventing vibrations and loud running in a drum of a washing machine while operating according to claim 1.

BACKGROUND OF THE INVENTION

Washing machines are devices that allow rinsing, washing and drying of laundries. When the washing machine is operating, drum in the washing machine may experience vibrations and also becomes unbalanced. The vibration or unbalance of the drum arises when the laundry is not distributed properly in the drum or the drum is not well designed during manufacturing. The vibratory operation of the drum causes a user to feel uncomfortable due to loud running sound. Additionally, the vibrating operation of the drum reduces the life span of the washing machine. Various methods for preventing vibrations are known in the prior art such as providing balancers and imbalance-compensating devices. However, providing balancers and imbalance-compensating devices may cause structural complexity.

Prior art document US2016258102 (A1) discloses a washing machine having an improved balancing function. The washing machine includes a cabinet, a drum disposed in the cabinet to be rotatable, a balancer installed at the drum to offset an unbalanced load generated at the drum when the drum is rotated, and at least one magnetic body disposed between the balancer and the drum.

Another prior art WO2017009170 (A1) relates to a domestic appliance for caring for laundry items, comprising at least one laundry drum for holding laundry items and at least one imbalance-compensating device which is arranged on the laundry drum and which has a housing in which a plurality of compensating elements are movably contained, of which at least some are magnetic and, at least in some regions, are designed as permanent magnets, wherein the imbalance-compensating device has at least one magnetically interacting component for magnetically interacting with the magnetic compensating elements which magnetically interacting component is rotationally coupled to the laundry drum, wherein the magnetic compensating elements and the magnetically interacting component have such a magnetic holding force with respect to each other that the compensating elements are not released from the magnetically interacting component until a rotational speed of the laundry drum is greater than a specified reference rotational speed UR of the laundry drum.

The subject-matter of the prior art does not provide a balancing apparatus with simple configuration to prevent vibrations and loud running in a drum of a washing machine while operating.

OBJECT OF THE INVENTION

It is therefore the object of the present invention to provide a balancing apparatus for preventing vibrations and loud running in a drum of a washing machine while operating by using a simple configuration.

DESCRIPTION OF THE INVENTION

The before mentioned object is solved by a balancing apparatus that prevents vibrations and loud running in a drum of a washing machine while operating by using magnetic property and simple configuration according to claim 1. The present invention refers to a balancing apparatus for preventing vibrations and loud running in a drum of a washing machine while operating. The balancing apparatus according to the present invention preferably comprises of a plurality of propellers attached to the drum and at least two half rings. The plurality of propellers is attached to the drum. The two half rings are configured to cover the drum. The propellers and the half rings are magnetically polarized while electric current is passing through the propellers and half rings. The drum is balanced by forming similar polarity in poles of the half rings and the poles of the propellers facing each other.

This solution is beneficial since such a balancing apparatus enables prevention of vibrations and loud running in a drum of a washing machine while operating using magnetic property. While the washing machine is operating, the propellers and the half rings are magnetically polarized by passing electric current through the propellers and the half rings. The drum is balanced by forming similar polarity in the poles of the propellers and the poles of the half rings facing each other. Hence the vibrations and loud running is prevented and the balancing of the drum is achieved using magnetic property of the propellers and the half rings. Additionally, the implementation of such a balancing apparatus is simple and effective.

Further preferred embodiments are subject-matter of dependent claims and/or of the following specification parts.

According to a preferred embodiment of the present invention the balancing apparatus further includes at least one ball and a sensor. The ball is placed between the half ring and the drum. The ball is magnetically polarized while the electric current is passing through the ball. The sensor is configured for measuring the distance from the ball to the drum and the distance from the ball to the half ring. The distance measured by the sensor enables to determine whether the poles of the half rings and the poles of the propellers facing each other are similar or opposite.

The poles of the half rings and the poles of the propellers facing each other are identified similar when the difference between the distance from the ball to the drum and distance from the ball to the half ring is zero. The poles of the half rings and the poles of the propellers facing each other are identified opposite when the difference between the distance from the ball to the drum and distance from the ball to the half ring is non-zero. The opposite polarity in the poles of the half rings and the poles of the propellers facing each other are changed to similar polarity by reversing the current flow through the half ring and/or the propellers.

Further benefits, goals and features of the present invention will be described by the following specification of the attached figures, in which components of the invention are exemplarily illustrated. Components of the devices and method according to the inventions, which match at least essentially with respect to their function, can be marked with the same reference sign, wherein such components do not have to be marked or described in all figures.

The invention is just exemplarily described with respect to the attached figures in the following.

BRIEF DESCRIPTION OF THE DRAWING

FIG. 1 illustrates an exemplary model of a balancing apparatus 100 that shows position of ball when the polarity of the poles of the half ring and the poles of the propellers facing each other are similar, according to the present invention.

DETAILED DESCRIPTION OF THE DRAWING

FIG. 1 illustrates an exemplary model of a balancing apparatus 100 that shows position of ball when the polarity of the poles of the half ring 2 and the poles of the propellers 3 facing each other are similar, according to the present invention. The drum 1 is balanced using magnetic properties of the propellers 3 and the half rings 2. In order to achieve this, the present invention preferably comprises of a plurality of propellers 3 and at least two half rings 2.

According to an embodiment of the invention, the propellers 3 and the half rings 2 are made up of magnetically polarizable materials. The plurality of propellers 3 is attached to the drum 1. The two half rings 2 are configured to cover the drum 1. The propellers 3 and the half rings 2 are magnetically polarized while electric current is passing through the propellers 3 and half rings 2. The drum 1 is balanced by forming similar polarity in poles of the half rings 2 and the poles of the propellers 3 facing each other. Thus, the propellers 3 inside the drum 1 are pushed by the external magnetic force applied by the half rings 2 outside the drum 1 and thus the drum 1 is balanced.

This solution is beneficial since such a balancing apparatus 100 enables prevention of vibrations and loud running in a drum 1 of a washing machine while operating. While the washing machine is operating, the propellers 3 and the half rings 2 are magnetically polarized by passing electric current through the propellers 3 and the half rings 2. The drum 1 is balanced by forming similar polarity in the poles of the propellers 3 and the poles of the half rings 2 facing each other. Hence, the vibrations and loud running is prevented and the balancing of the drum 1 is achieved using magnetic property of the propellers 3 and the half rings 2. Additionally, implementation of such a balancing apparatus 100 is simple and effective.

According to an embodiment of the invention, the balancing apparatus 100 further includes at least one ball 4 and a sensor 5. The ball 4 is placed between the half ring 2 and the drum 1. The ball 4 is magnetically polarized while the electric current is passing through the ball 4. The sensor 5 is configured for measuring the distance from the ball 4 to the drum 1 and the distance from the ball 4 to the half ring 2. The distance measured by the sensor 5 enables to determine whether the poles of the half rings 2 and the poles of the propellers 3 facing each other are similar or opposite.

The poles of the half rings and the poles of the propellers facing each other are identified similar when the difference between the distance from the ball 4 to the drum 1 and distance from the ball 4 to the half ring 2 is zero. The poles of the half rings 2 and the poles of the propellers 3 facing each other are identified opposite when the difference between the distance from the ball 4 to the drum 1 and distance from the ball 4 to the half ring 2 is non-zero. The opposite polarity in the poles of the half rings 2 and the poles of the propellers 3 facing each other are changed to similar polarity by reversing the current flow through the half ring 2 and/or the propellers 3.

Thus, the present invention provides a balancing apparatus 100 that prevents vibrations and loud running in a drum 1 of a washing machine while operating by using magnetic property and simple configuration. The balancing apparatus 100 according to the present invention preferably comprises of at least two half rings 2 and a plurality of propellers 3. The plurality of propellers is attached to the drum 1. The two half rings 2 are configured to cover the drum 1. The propellers 3 and the half rings 2 are magnetically polarized while electric current is passing through the propellers 3 and half rings 2. The drum 1 is balanced by forming similar polarity in poles of the half rings 2 and the poles of the propellers 3 facing each other.

LIST OF REFERENCE NUMBERS

1 Drum
2 Half ring
3 Propellers
4 Ball
5 Sensor

The invention claimed is:

1. A balancing apparatus for preventing vibrations and loud running in a drum of a washing machine while operating, wherein the balancing apparatus comprising:

a plurality of propellers attached to the drum, characterized in that the balancing apparatus further includes at least two half rings, wherein the two half rings are configured to cover the drum, wherein the propellers and the half rings are magnetically polarized while electric current is passing through the propellers and half rings, wherein the drum is balanced by forming a similar polarity in poles of the half rings and the poles of the propellers facing each other;

wherein the balancing apparatus further includes at least one ball placed between the half rings and the drum; and the balancing apparatus further includes a sensor for measuring the distance from the ball to the drum and the distance from the ball to the half rings.

2. The balancing apparatus as claimed in claim 1, wherein the ball is magnetically polarized while the electric current is passing through the ball.

3. The balancing apparatus as claimed in claim 1, wherein distance measured by the sensor enables to determine whether the poles of the half rings and the poles of the drum facing each other are similar or opposite.

4. The balancing apparatus as claimed in claim 3, wherein the poles of the half rings and the poles of the propellers facing each other are identified similar when the difference between the distance from the ball to the drum and distance from the ball to the half rings is zero.

5. The balancing apparatus as claimed in claim 3, wherein the poles of the half rings and the poles of the propellers facing each other are identified opposite when the difference between the distance from the ball to the drum and distance from the ball to the half rings is non-zero.

6. The balancing apparatus as claimed in claim 4, wherein the opposite polarity in the poles of the half rings and the poles of the propellers are changed to similar polarity by reversing the current flow through the half rings and/or the propeller.

* * * * *